United States Patent [19]

May

[11] 3,953,371

[45] Apr. 27, 1976

[54] CONTROLLED GRAIN SIZE METAL OXIDE VARISTOR AND PROCESS FOR MAKING

[75] Inventor: John E. May, Skaneateles, N.Y.

[73] Assignee: General Electric Company, Syracuse, N.Y.

[22] Filed: Nov. 12, 1973

[21] Appl. No.: 414,714

[52] U.S. Cl. ..... 252/512; 252/518; 252/520; 264/61; 338/20; 428/538

[51] Int. Cl.[2] ..... H01B 1/08

[58] Field of Search ..... 252/512, 518, 520, 521; 264/61; 428/469, 538; 338/20

[56] References Cited

UNITED STATES PATENTS

| | | | |
|---|---|---|---|
| 3,652,378 | 3/1972 | Mistler | 264/61 X |
| 3,663,458 | 5/1972 | Masuyama et al. | 252/520 X |

*Primary Examiner*—Benjamin R. Padgett
*Assistant Examiner*—E. Suzanne Parr
*Attorney, Agent, or Firm*—R. J. Mooney; D. E. Stoner

[57] ABSTRACT

Disclosed is a metal oxide varistor consisting primarily of metal oxide with a small percentage of preselected additives distributed substantially evenly therethrough. A grain growth inhibitor is combined with the metal oxide powder forming a final mix with peripheral regions having a high concentration of the inhibitor that surround and separate interior regions that have a low concentration of the inhibitor. Varistor bodies are formed from the final mix and the peripheral and interior regions retain their identities in the varistor bodies. The bodies can be pressed and sintered in the conventional manner. During sintering the grains within each interior region tend to combine and grow. However, growth is stopped at the peripheral regions due to the high concentration of inhibitor. Thus, the grain size in the processed pellet is dependent upon the size of the interior regions which can be controlled. If desired, one of the additives can be chosen to stimulate grain growth so as to promote the combination and growth within the interior regions. One preferred method of forming the interior regions is to coalesce the metal oxide powder by techniques such as spray drying and then coat the agglomerates thus formed with grain growth inhibitor.

12 Claims, 3 Drawing Figures

FIG. 2.

CONTROLLED GRAIN SIZE METAL OXIDE VARISTOR AND PROCESS FOR MAKING

BACKGROUND OF THE INVENTION

This invention relates to metal oxide varistors and, more particularly, to a method of controlling the size of the metal oxide grains in varistors and thus to provide more uniform and improved devices.

In general, the current flowing between two spaced points is directly proportional to the potential difference between those points. For most known substances, current conduction therethrough is equal to the applied potential difference divided by a constant, which has been defined by Ohm's law to be its resistance. There are, however, a few substances which exhibit non-linear resistance. Some devices, such as metal oxide varistors, utilize these substances and require resort to the following equation (1) to quantitatively relate current and voltage:

$$I = \left(\frac{V}{C}\right)^{\alpha} \qquad (1)$$

where $V$ is the voltage applied to the device, $I$ is the current flowing through the device, $C$ is a constant and $\alpha$ is an exponent greater than 1. Inasmuch as the value of $\alpha$ determines the degree of non-linearity exhibited by the device, it is generally desired that $\alpha$ be relatively high. $\alpha$ is calculated according to the following equation (2):

$$\alpha = \frac{\log_{10}(I_2/I_1)}{\log_{10}(V_2/V_1)} \qquad (2)$$

where $V_1$ and $V_2$ are the device voltages at given currents $I_1$ and $I_2$, respectively.

At very low voltages and very high voltages metal oxide varistors deviate from the characteristics expressed by equation (1) and approach linear resistance characteristics. However, for a very broad useful voltage range the response of metal oxide varistors is as expressed by equation (1).

The values of C and $\alpha$ can be varied over wide ranges by changing the varistor formulation or the manufacturing process. Another useful varistor characteristic is the varistor voltage which can be defined as the voltage across the device when a given current is flowing through it. It is common to measure varistor voltage at a current of one milliampere and subsequent reference to varistor voltage shall be for voltage so measured. The foregoing is, of course, well known in the prior art.

Metal oxide varistors are usually manufactured as follows. A plurality of additives is mixed with a powdered metal oxide, commonly zinc oxide. Typically, four to twelve additives are employed, yet together they comprise only a small portion of the end product, for example less than five to ten mole percent. In some instances the additives comprise less than one mole percent. The types and amounts of additives employed vary with the properties sought in the varistor. Copious literature describes metal oxide varistors utilizing various additive combinations. For example, see U.S. Pat. No. 3,663,458. A portion of the metal oxide and additive mixture is then pressed into a body of a desired shape and size. The body is then sintered for an appropriate time at a suitable temperature as is well known in the prior art. Sintering causes the necessary reactions among the additives and the metal oxide and fuses the mixture into a coherent pellet. Leads are then attached and the device is encapsulated by conventional methods.

A problem encountered in the manufacture of metal oxide varistors by the prior art method is the inability to precisely predict and control the properties of the device. Thus, manufacturing yield is a matter of concern to varistor manufacturers. It is known that commercially available metal oxide varistors are granular in structure. A consideration of grain structure and grain size will furnish an example of the inability of manufacturers to control the final device properties. While the conduction process in metal oxide varistors is not fully understood, it is believed that the mechanism creating the varistor action takes place at the intergranular phase that separates the grains in the finished varistor. It was reasoned therefore that the varistor voltage is at least in part dependent upon the average number of intergranular regions between the two contacts. Thus, it was felt that controlling the number of intergranular regions would aid in controlling the varistor voltage. Efforts were made to embody this theory in varistors by controlling the grain size in the finished varistors and thus controlling the number of intergranular regions. However, it was found that existing manufacturing techniques were inadequate to control the grain size with sufficient accuracy to yield improved devices. For example, one method explored in an effort to make a low voltage varistor was controlling the sintering process so that the grain size became relatively large. Unfortunately, individual grains often became too large and established a current path between the contacts with very few intergranular regions. Upon conduction of the varistor, the bulk of the current passed through this preferred path with few interfaces creating an unacceptably high current density therein and leading to device failure. In summary, it has not heretofore been possible to exert a precise enough control over grain size to utilize the effect that grain size is believed to have on varistor voltage.

It is, therefore, an object of this invention to provide a varistor and a method for the fabrication thereof wherein the grain size in the varistor is simply and accurately controlled and thus to permit precise prediction of device properties.

SUMMARY OF THE INVENTION

This invention is characterized by a metal oxide varistor and a process for the manufacture thereof. A granular metal oxide powder that comprises a small amount of at least one preselected additive is combined with a grain growth inhibitor. The combination process is performed such that interior regions with a low concentration of grain growth inhibitor are surrounded and separated by peripheral regions that contain a high concentration of grain growth inhibitor. A metal oxide varistor body is formed from this material as, for example, by pressing and sintering. The grains in the metal oxide material have a tendency to grow and combine during the sintering process. However, the growth process is inhibited at the peripheral regions due to the grain growth inhibitor concentration. Thus, the final grain size is strongly dependent upon the size of the interior regions. Consequently the ability to control the size of the interior regions permits control of the final grain size. In a preferred method disclosed herein a grain growth stimulator is added to the granular metal oxide material thus increasing the tendency for each interior region to form a single grain during the sintering process.

A feature of this invention is the compatability of the subject method with conventional metal oxide varistor manufacturing techniques. More specifically, the metal oxide powder, after the additives have been combined therewith, is often spray dried to insure complete mixing and flowability thereof. Flowability is desired because the metal oxide varistor bodies are generally formed by pressing. It has been found that, for many applications, the size of the agglomerates produced by the spray drying process can be controlled so as to be a suitable final grain size. Consequently, the process can be carried out by coating the spray dried particles with the grain growth inhibitor and then pressing and sintering. Therefore, there is little cost added to varistor manufacture when practicing the subject method.

An alternate preferred method disclosed herein yields a varistor with a clearly layered structure. A thin layer of the granular metal oxide powder is placed in a press and covered with a thin layer of grain growth inhibitor or metal oxide powder mixed with a substantial amount of grain growth inhibitor. Subsequent layers of granular metal oxide powder and grain growth inhibitor are deposited until a selected depth is reached. The material can be pressed at intermediate steps in processing or can be pressed once after all layers are deposited. During sintering each layer of granular metal oxide powder will undergo substantial grain growth and combination and will approach a substantially monocrystalline state.

DESCRIPTION OF THE DRAWINGS

These and other features and objects of the present invention will become more apparent upon perusal of the following description taken in conjunction with the accompanying drawings wherein.

DESCRIPTION OF THE PREFERRED EMBODIMENT AND METHOD

Figure 1:
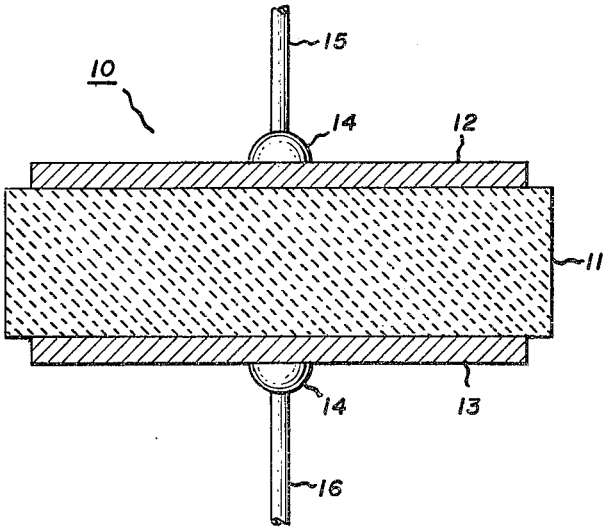
FIG. 1 is a sectional elevation view of a metal oxide varistor.

Before proceeding with a detailed description of the method of manufacturing varistors contemplated by this invention, varistor construction will generally be described with reference to FIG. 1. A varistor 10 includes as its active element a sintered body portion 11 having a pair of electrodes 12 and 13 in ohmic contact with the opposite surfaces thereof. The body 11 is prepared as hereinafter set forth and can be in any form such as circular, square or rectangular. Wire leads 15 and 16 are conductively attached to the electrodes 12 and 13, respectively, by a connection material 14 such as solder.

Figure 2:
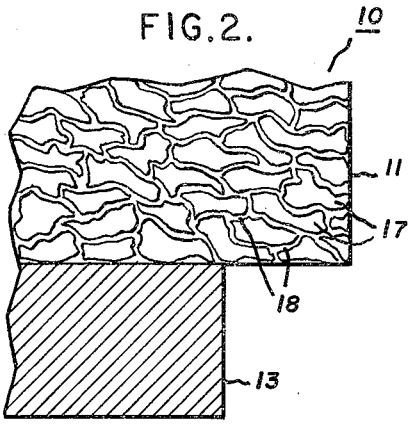
FIG. 2 is a sectional detail view of a portion of the varistor depicted in FIG. 1 showing the granular structure thereof.

Referring now to FIG. 2 there is shown a portion of the varistor 10 depicted in FIG. 1 with the granular structure of the sintered body 11 visible. The body is seen to consist of many irregularly shaped grains 17 separated by an intergranular phase 18.

Fabrication of the varistor 10 depicted in the Figures proceeds generally as follows. A selected metal oxide, such as zinc oxide, is mixed with at least one preselected additive. For example, it is found that a varistor with excellent electrical properties can be fabricated from 98 mole % zinc oxide, 0.5 mole % bismuth oxide, 0.5 mole % manganese oxide, 0.5 mole % cobalt oxide and 0.5 mole % titanium oxide. It is believed that titanium oxide is a grain growth stimulator in the aforementioned formulation. The ingredients are thoroughly mixed providing a granular metal oxide powder with the additives dispersed substantially evenly therethrough. For example, the ingredients can be wet mixed and dried.

A grain growth inhibitor is then combined with the aforementioned metal oxide powder to form a final mix. In accordance with a preferred method interior regions with low concentrations of the grain growth inhibitor are surrounded and separated by peripheral regions that have a relatively high concentration of the grain growth inhibitor. One preferred method of combining the grain growth inhibitor with the other materials is as follows. The aforementioned wet mix and drying can comprise spray drying. If necessary a binder can be used. Spray drying forms agglomerates, each agglomerate comprising many grains. The agglomerates obtained by spray drying are coated with a grain growth inhibitor. For example, chromium or chromium oxide are effective grain growth inhibitors. The total chromium content of the finished varistor can be as little as a quarter of a mole percent. However, in order to be effective, care should be taken to insure that the chromium is substantially entirely in the peripheral regions which are formed by coating the agglomerates.

The final mix is then pressed to form a coherent body and sintered in a conventional manner. During the sintering process the interior regions undergo substantial grain growth and combination and, if the sintering is carried out at a relatively high temperature, such as 1300° C, each interior region will become substantially monocrystalline. It will be appreciated that grain growth and combination in the interior regions generally ceases at the interface of the interior regions and the peripheral regions because of the high concentration of grain growth inhibitor in the peripheral regions. Thus, the structure depicted in FIG. 2 with the intergranular region 18 forming a cellular superstructure around the individual grains 17 is produced.

Granular metal oxide powder mixed in accordance with the aforementioned formula was spray dried. The agglomerates were mixed by tumbling with relatively fine grained chromium oxide particles. Following pressing and sintering at approximately 1300° C, a varistor with an alpha of 27 and a varistor voltage of 65 volts was provided.

Other varistors were fabricated with the aforementioned spray dried agglomerates and grain growth inhibitors comprising chromium oxide, manganese oxide, bismuth oxide and boric acid. Sintering was carried out at temperatures ranging from 1180° C to 1300° C. Varistors with excellent electrical characteristics were provided by each process.

Observation of FIG. 2 will show that most of the grains 17 are somewhat flattened. The layered structure revealed results from the pressing operation and is felt to be beneficial inasmuch as a substantially uniform number of intergranular regions will be in any potential current path between the electrodes 12 and 13. In addition, it will be clear upon observation of FIG. 2 that the grains 17 are not all of the same size. Nevertheless, the grain sizes are controlled in that they are related to the size of the agglomerates produced by the spray drying which is within selected limits. Controlling the size of spray dried particles is well within the ability of those skilled in the art. If it is desired that the grains 17 be of a uniform size rather than within a controlled range, that can be achieved by techniques such as the following. The grains can be spray dried as described above and sorted with a series of meshes to divide the agglomerates according to size.

Figure 3:
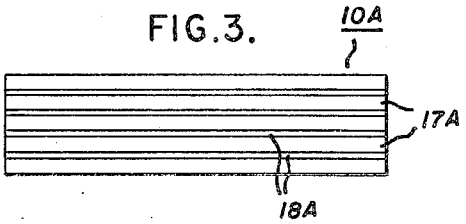
FIG. 3 is an alternate varistor body fabricated in accordance with this invention.

Referring now to FIG. 3 there is shown a layered varistor body 10A including alternate interior regions 17A and peripheral regions 18A. The body 10A is formed by alternately depositing layers of granular metal oxide powder and grain growth inhibitor or metal oxide powder combined with a substantial portion of grain growth inhibitor in a mold and pressing. Following pressing, the body is sintered in a conventional manner. The interior regions 17A undergo substantial grain growth and combination and, depending on sintering time and temperature, may become substantially monocrystalline. It will be appreciated upon observation of FIG. 3 that a preselected minimum number of intergranular regions in any current path can be assured inasmuch as an intergranular region occurs at each peripheral region 18A.

It will, of course, be appreciated that many variations can be made in this process. For example, other grain growth inhibitors, such as nickel or antimony trioxide, could be employed. Furthermore, other grain growth stimulators could be used. In addition, still other inhibitors and stimulators will be useful if the base material is chosen to be something other than zinc oxide. Also, agglomerates of uniform size can be formed by wet mixing, drying, grinding and sifting. Consequently, many modifications and variations of the subject invention will be apparent to those skilled in the art. It will be appreciated, therefore, that the invention can be practiced otherwise than as specifically described.

What is claimed is:

1. A varistor comprising a sintered body portion consisting essentially of layered granular material of a controlled grain size, said granular material consisting essentially of zinc oxide, said body portion comprising grain growth inhibitor means in an intergranular phase bounding the grains.

2. A varistor according to claim 1 wherein said body portion further comprises grain growth stimulator means.

3. A varistor according to claim 2 wherein said grain growth inhibitor means comprises chromium.

4. A varistor according to claim 3 wherein said grain growth stimulator means comprises titanium oxide.

5. A varistor according to claim 2 wherein said intergranular phase is in the form of a cellular superstructure.

6. A varistor according to claim 1 comprising a substantially layered structure.

7. A process for manufacturing a metal oxide varistor comprising the steps of:

providing a granular metal oxide powder consisting primarily of zinc oxide with a small amount of at least one preselected additive dispersed substantially evenly therethrough;

combining said metal oxide powder with a grain growth inhibitor to form a final mix with peripheral regions containing a relatively high concentration of said grain growth inhibitor surrounding and separating interior regions which contain low concentrations of said grain growth inhibitor; and, pressing and sintering a varistor pellet with a portion of said final mix, said substep of sintering stimulating substantial grain growth in each of said interior regions.

8. A method according to claim 7 wherein said combining step comprises the sub steps of coalescing said granular metal oxide powder into agglomerates comprising a plurality of grains of said granular metal oxide powder, and coating said agglomerates with powder consisting essentially of said grain growth inhibitor.

9. A method according to claim 8 wherein said granular metal oxide powder further comprises grain growth stimulator dispersed substantially evenly therethrough.

10. A method according to claim 8 wherein said coalescing step comprises spray drying.

11. A method according to claim 10 wherein said grain growth stimulator comprises titanium oxide and said grain growth inhibitor comprises chromium.

12. A method according to claim 7 wherein said combining step comprises forming alternating layers of said metal oxide powder and said grain growth inhibitor.

* * * * *